United States Patent [19]

Todaka et al.

[11] Patent Number: 4,482,888

[45] Date of Patent: Nov. 13, 1984

[54] ALARMING APPARATUS

[75] Inventors: Seizi Todaka, Tokyo; Teruaki Tanaka, Yokohama, both of Japan

[73] Assignee: Tokyo Shibaura Denki Kabushiki Kaisha, Kawasaki, Japan

[21] Appl. No.: 324,630

[22] Filed: Nov. 24, 1981

[30] Foreign Application Priority Data

Nov. 28, 1980 [JP] Japan ..... 55-167432
Nov. 28, 1980 [JP] Japan ..... 55-167433
Nov. 28, 1980 [JP] Japan ..... 55-167434

[51] Int. Cl.[3] ..... G08B 3/00
[52] U.S. Cl. ..... 340/384 E; 340/384 R
[58] Field of Search ..... 340/384 E, 384 R; 84/1.27, 1.09, 1.1; 331/177 R, 179, 107 A

[56] References Cited

U.S. PATENT DOCUMENTS 4,001,816 1/1977 Yamada et al. ..... 340/384 E
4,110,750 8/1978 Heyning et al. ..... 340/384 E
4,187,670 2/1980 Okano ..... 340/384 E
4,206,448 6/1980 Davis ..... 340/384 E
4,232,305 11/1980 Lelaidier et al. ..... 340/384 E

FOREIGN PATENT DOCUMENTS 2090450 7/1982 United Kingdom ..... 340/384 E

*Primary Examiner*—Gerald L. Brigance
*Attorney, Agent, or Firm*—Finnegan, Henderson, Farabow, Garrett & Dunner

[57] ABSTRACT

An alarming apparatus having a sound volume level setting circuit for setting the volume level of the sound produced from a sound generating circuit to one of a plurality of different sound volume levels. A modulating circuit varies the frequency, duty ratio (pulse duration) or amplitude of the signal transmitted from the oscillating circuit. The sound generating circuit produces sound having one of a plurality of different volume levels according to the signal transmitted from said modulating circuit.

8 Claims, 17 Drawing Figures

ALARMING APPARATUS

BACKGROUND OF THE INVENTION

This invention relates to alarming apparatus and, more particularly, to alarming apparatus capable of selecting the volume of the alarming sound.

Recently, electronic timepieces which have an alarming function and can inform of a given alarm time with a buzzer have been extensively used. With such electronic timepieces, however, the buzzer produces sound of a constant volume or pressure level. Therefore, it occasionally happens that an alarm time as set fails to be audible to other people even though the user himself is made aware of it. In addition, the user occasionally fails to hear the alarm sound the surrounding is noisy. Conversely, when in a quiet situation, the alarm sound may be troublesome to people other than the user. Further, the timepiece has an additional disadvantage in that an alarm time of which only the user himself wishes to be informed is also known to other people.

SUMMARY OF THE INVENTION

The invention, accordingly, seeks to provide an alarming apparatus, which can produce alarming sound with the volume thereof set to an optimum level depending upon a situation.

This object has been achieved by an alarming apparatus which comprises an oscillating means, a sound volume level setting means for setting the volume level of output sound to one of a plurality of different levels, a modulating means for modulating a signal transmitted from the oscillating means according to a signal representing a sound level transmitted from the sound level setting means, and a sound producing means for generating sound according to a signal transmitted from the modulating means.

According to the invention, it is thus possible to set the level of the sound generated to one of a plurality of different levels with the sound level setting means. Thus, optimum alarm sound can be produced by setting an optimum sound level depending upon surroundings.

BRIEF DESCRIPTION OF THE DRAWINGS

By way of example and to make the description clearer, reference is made to the accompanying drawings, in which.

DETAILED DESCRIPTION OF THE PREFERRED EMBODIMENTS

Figure 1:
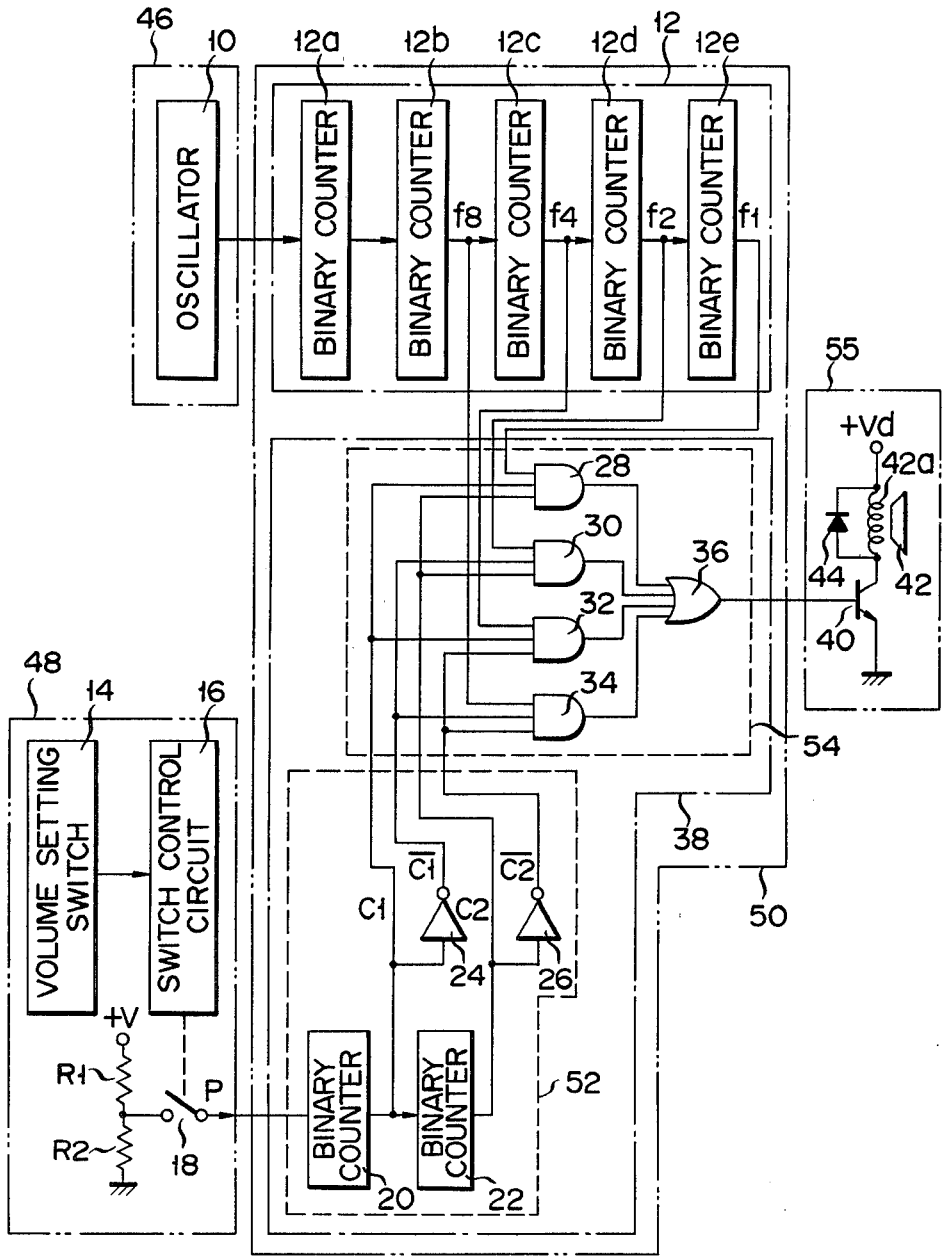
FIG. 1. is a circuit diagram, partly in block form, showing the circuit construction of a first embodiment of the invention.

FIG. 1 is a circuit diagram, partly in block form, showing the circuit construction of a first embodiment of the invention.

In FIG. 1, a signal generated from an oscillator 10 is frequency divided by a frequency divider 12. Frequency divider 12 includes a plurality of binary counters 12*a* to 12*e*. Binary counter 12*b* generates an 8-kHz frequency signal f8; binary counter 12*c* a 4-kHz frequency signal f4; binary counter 12*d* a 2-kHz frequency signal f2; and the binary counter 12*e* a 1-kHz frequency signal f1.

A volume setting switch 14, which is provided in, for instance, a casing of electronic timepiece, permits the presetting of "strong sound", "medium sound" and "weak sound" levels. Preset volume level information provided from switch 14 is supplied to a switch control circuit 16. Switch control circuit 16 on-off operates a switch 18 according to the input preset volume level information to cause switch 18 to generate a predetermined number of control pulses P. When closed, switch 18 provides the aforementioned control pulses P, the voltage of which is equal to a supply voltage (+V) divided by resistors R1 and R2.

Control pulses P from switch 18 are supplied to a binary counter 20, and the output thereof is supplied to a binary counter 22. Binary counters 20 and 22 thus provide respective signals C1 and C2, which are determined according to the number of control pulses P outputted. The output terminals of counters 20 and 22 are connected to respective NOT circuits 24 and 26, which invert their input signals C1 and C2 to obtain inverted signals $\overline{C1}$ and $\overline{C2}$. The aforementioned frequency signals f8, f4, f2 and f1 and the signals C1, $\overline{C1}$, C2 and $\overline{C2}$ are supplied to respective AND circuits 28, 30, 32 and 34, and the outputs thereof are supplied to an OR circuit 36. Binary counters 20 and 22, NOT circuits 24 and 26, AND circuits 28, 30, 32 and 34 and OR circuit 36 constitute a frequency selection circuit 38. A frequency signal corresponding to the preset volume level information from volume setting switch 14 is provided from frequency selection circuit 18, more specifically, from OR circuit 36. The frequency signal output of frequency selection circuit 38 is supplied to the base of an npn transistor 40.

When transistor 40 is on, a direct current voltage Vd for driving a loudspeaker 42 is supplied to a drive coil 42*a* of loudspeaker 42. The direct current voltage Vd begins to be supplied when a preset alarm time is reached, and continues to be supplied only for a constant period of time. A surge voltage absorption diode 44 is connected across drive coil 42*a*.

Oscillator 10 constitutes an oscillating means 46. Volume setting switch 14, switch control circuit 16 and switch 18 on-off operated by the control circuit 16 constitute a volume setting circuit 48. Frequency divider 12 and frequency selection circuit 38 constitute a modulating means 50. Counters 20 and 22 and NOT circuits 24 and 26 constitute a counter section 52. AND circuits 28, 30, 32 and 34 constitute a decoder section 54. Counter section 52 and decoder section 54 constitute the frequency selection circuit 38. Transistor 40, loudspeaker 42, drive coil 42*a* and diode 44 constitute a sound generating means 55.

Figure 2:
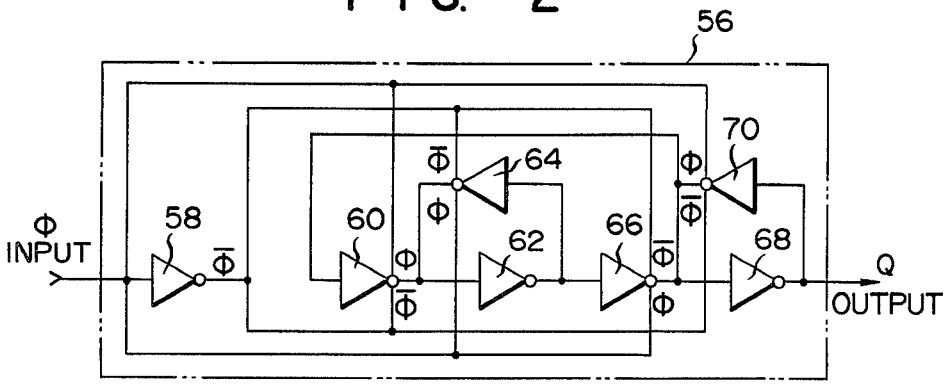
FIG. 2 is a circuit diagram of a binary counter which may be used for binary counters 12*a* to 12*e*, 20 and 22 in FIG. 1.

Binary counters 12*a* to 12*e*, 20 and 22 may each have a circuit construction as shown in FIG. 2, including clocked inverters and ordinary inverters. Binary counter 56 shown in FIG. 2 includes a first inverter 58 for inverting an input signal $\phi$ to provide an output signal $\overline{\phi}$; a first clocked inverter 60 for inverting the input signal when clock signals $\phi$ and $\overline{\phi}$ are given; a second inverter 62 for inverting the output of the first clocked inverter 60; a second clocked inverter 64 for inverting the output of second inverter 62 when clock signals $\phi$ and $\overline{\phi}$ are given, and providing an inverted output thus obtained to the input terminal of second inverter 62, a third clocked inverter 66 for inverting the output of second inverter 62 when clock signals $\phi$ and $\overline{\phi}$ are given; a third inverter 68 for inverting the output of third clocked inverter 66; and a fourth clocked inverter 70 for supplying the output of third inverter 68 to the input terminal of third inverter 68 and also to the input terminal of third clocked inverter 60 when clock signals $\phi$ and $\overline{\phi}$ are given.

Figure 3:
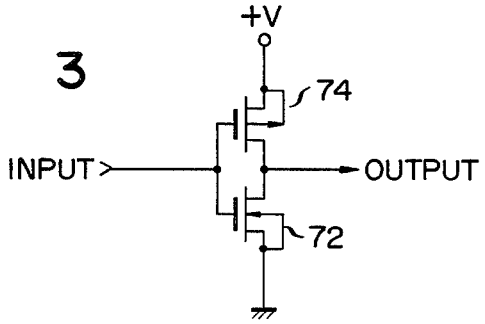
FIG. 3 is a circuit diagram of an inverter which may be used for first to third inverters 58, 62 and 68 in FIG. 1.
Figure 4A:
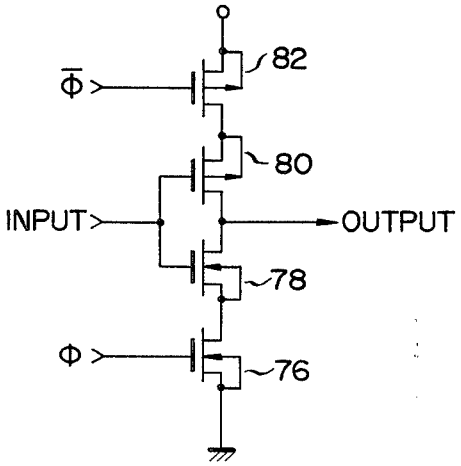
FIG. 4A is a circuit diagram of a clocked inverter which may be used for first and third clocked inverters 60 and 66 in FIG. 1.
Figure 4B:
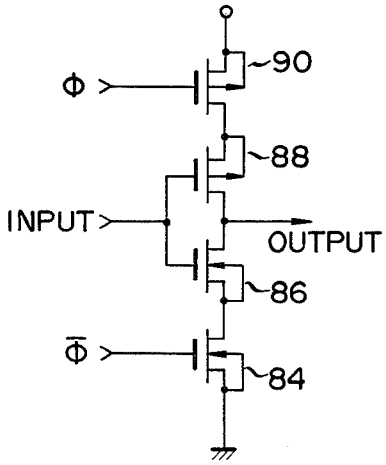
FIG. 4B is a circuit diagram of a clocked inverter which may be used for second and fourth clocked inverters 64 and 70 in FIG. 1.

First to third inverters 58, 62 and 68 may each have a series circuit construction as shown in FIG. 3, including an n-channel MOS field-effect transistor (FET) 72 and a p-channel MOS FET 74. Second and third clocked inverters 64 and 66 may each have a series circuit construction, as shown in FIG. 4A, including two n-channel MOS FETs 76 and 78 and two p-channel MOS FETs 80 and 82. Clocked inverter shown in FIG. 4A inverts the input when clock signal $\phi$ is at high level. First and fourth clocked inverters 60 and 70 may have a series circuit construction as shown in FIG. 4B, including two n-channel MOS FETs 84 and 86 and two p-channel MOS FETs 88 and 90. Clocked inverter shown in FIG. 4B inverts the input when the clock signal $\overline{\phi}$ is at high level.

Figure 5:
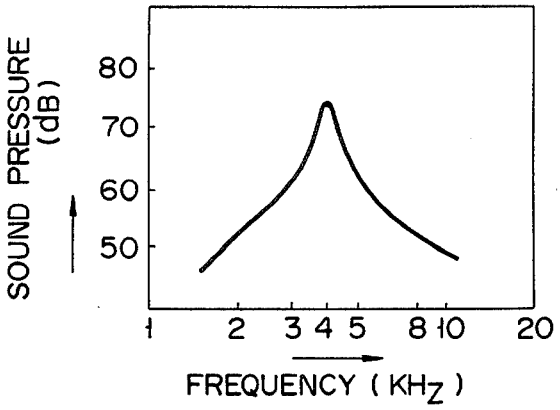
FIG. 5 is a sound pressure versus frequency characteristic of loudspeaker 42 in FIG. 1.

FIG. 5 shows the sound pressure versus frequency characteristic of loudspeaker 42. The sound pressure level is determined according to the frequency of the drive signal. More particularly, loudspeaker 42 is designed to operate with the maximum sound pressure when the drive signal frequency is 4 kHz; with somewhat attenuated sound pressure when the drive signal frequency is 8 and 2 kHz; and with a further attenuated sound pressure when the drive signal frequency is 1 kHz. The sound pressure versus frequency characteristic varies with kinds of loudspeakers.

Figure 6:
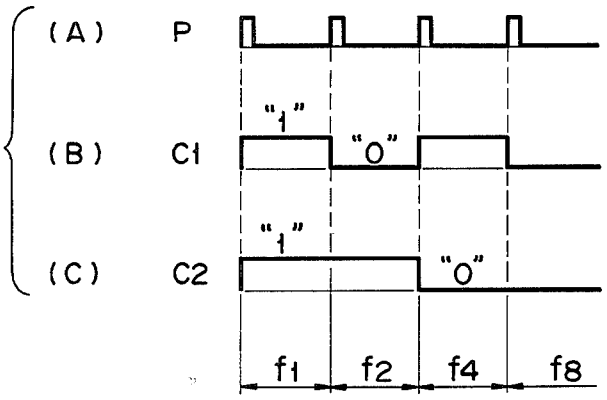
FIGS. 6(A) to 6(C) are timing charts for explaining the operation of the first embodiment shown in FIG. 1.

The operation of the above construction will now be described with reference to the timing chart of FIGS. 6(A) to 6(C). When the "strong sound" pressure level is set by switch 14, a predetermined number (determined by the preset sound volume) of control pulses P are generated from switch 18 to cause counter 20 to provide output signal C2 of logic level "1" and counter 22 to provide output signal C1 of logic level "0". As a result, frequency signal f4 is selected through AND circuits 28, 30, 32 and 34 and OR circuit 36. When a given alarm time is reached, the direct current voltage Vd for driving loudspeaker 42 is provided to cause the on-off operation of transistor 40 according to frequency signal f4, whereby a drive signal at a frequency of 4 kHz is supplied to loudspeaker 42. In this way, strong sound is produced from loudspeaker 42.

When the "strong sound" pressure level state is switched over to the "medium sound" by switch 14, switch 18 is caused to generate a single control pulse P, causing both counters 20 and 22 to provide output signals C1 and C2 of logic "0". As a result, the frequency signal f8 is selected through AND circuits 28, 30, 32 and 34 and OR circuit 36. When the alarm time is reached, the direct current voltage Vd for driving loudspeaker 42 is provided to cause the on-off operation of transistor 40 according to frequency signal f3, thereby supplying a drive signal at 8 kHz to loudspeaker 42. Thus, sound of the medium sound pressure level is produced from loudspeaker 42.

When the "medium sound" pressure level state is switched over to the "weak sound" by switch 14, switch 18 is caused to generate a single control pulse P, causing both counters 20 and 22 to provide output signals C1 and C2 of logic "1". As a result, frequency signal f1 is selected through AND circuits 28, 30, 32 and 34 and OR circuit 36. When the alarm time is reached, the direct current voltage Vd for driving loudspeaker 42 is provided to cause the on-off operation of transistor 40 according to frequency signal f1, thus supplying a drive signal of 1 kHz to loudspeaker 42 and causing loudspeaker 42 to produce sound of the "weak sound" pressure level.

It is to be understood that if the "strong sound" is set with switch 14, the alarm sound can be heard by the user even in a noisy situation. In addition, it is possible to let other people know the alarm time. Further, by setting the "weak sound" with switch 14, it is possible for the user to know the alarm time without bothering other people or without being heard by other people. Further, the ordinary alarm sound can be produced by setting the "medium sound" pressure level with switch 14.

While in the above embodiment frequency signal f8 (at 8 kHz) is selected when the "medium sound" is preset, it is also possible to obtain the same sound volume by arranging so that frequency signal f2 (at 2 kHz) is selected with the same setting.

Figure 7:
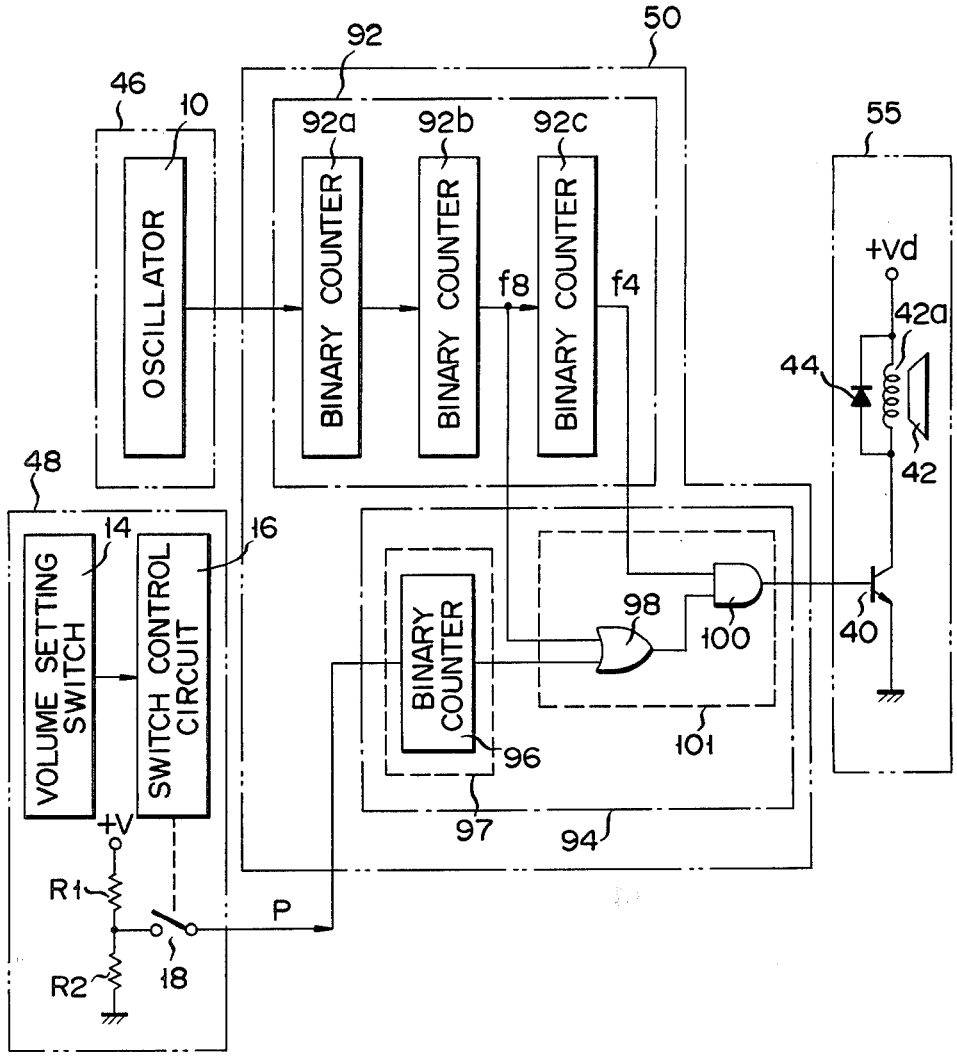
FIG. 7 is a circuit diagram, partly in block form, showing the circuit construction of a second embodiment of the invention.
Figure 8:
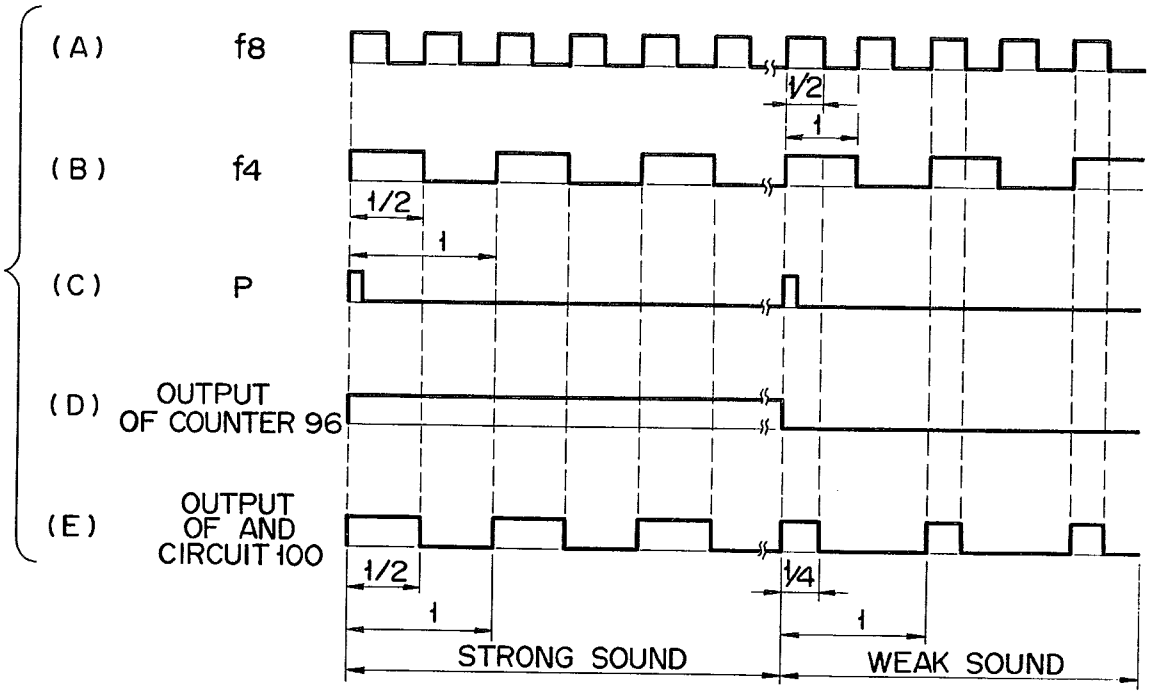
FIGS. 8(A) to 8(E) are timing charts for explaining the operation of the second embodiment shown in FIG. 7.

FIG. 7 is a circuit diagram, partly in block form, showing a second embodiment of the invention. Like parts as those in the first embodiment of FIG. 1 are designated by like reference numerals and symbols.

In FIG. 7, a signal generated from oscillator 10 is frequency divided by a frequency divider 92. Frequency divider 92 includes a plurality of binary counters 92*a* to 92*c* and provides an 8-kHz frequency signal (with a duty ratio of ½) f8 and a 4-kHz frequency signal (with a duty ratio of ½) f4.

Frequency signals f8 and f4 provided from switch 18 and control pulse signal P are supplied to a duty ratio control circuit 94. Duty ratio control circuit 94 includes a binary counter 96 receiving control pulse signal P, an OR circuit 98 receiving the output of binary counter 96 and signal f8 and an AND circuit 100 receiving the output of OR circuit 98 and the signal f4. This circuit 94 serves to change the duty ratio of the signal f4 according to the preset volume information, i.e., control pulse signal P. The output of duty ratio control circuit 94 (i.e., the output of AND circuit 100) is supplied to the base of npn transistor 40.

Binary counter 96 constitutes a counter section 97, and OR circuit 98 and AND circuit 100 constitute a logic circuit section 101.

The operation of the above construction will now be described with reference to the timing charts of FIGS. 8(A) to 8(E).

If the "strong sound" pressure level is set by switch 14, control pulse signal P is generated from switch 18, causing the output of counter 96 to go to logic "1". Thus, OR circuit 98 provides output signal of logic "1" irrespective of change of signal f8. As a result, a signal corresponding to the signal f4, i.e., signal of a frequency of 4 kHz with a duty ratio of ½, is provided from AND circuit 100 to be supplied to the base of transistor 40. When a given alarm time is reached the direct current voltage Vd for driving loudspeaker 42 is provided to cause the on-off operation of transistor 40 according to the output signal from AND circuit 100, thus supplying a drive signal of 4 kHz with the duty ratio of ½ to loudspeaker 42. In this way, strong sound is produced from loudspeaker 42.

When the "strong sound" pressure level stage is switched over to the "weak sound" state by switch 14, control pulse signal P is generated from switch 18, causing the output of counter 96 to go to logic "0", thereby causing signal f8 to be provided from OR circuit 98. AND circuit 100 ANDs signal f4 and signal f8 and provides a signal of a frequency of 4 kHz with a duty ratio of ¼ to the base of transistor 40. When the alarm time is reached, the direct current voltage Vd for driving loudspeaker 42 is provided to cause the on-off operation of transistor 40 according to the output signal from AND circuit 100, thus supplying the drive signal of 4 kHz with a duty ratio of ¼ to loudspeaker 42. In this way, weak sound is produced from loudspeaker 42.

It is to be understood that if the "strong sound" is set with switch 14, it is possible for the user to hear the alarm sound even in a noisy situation and further to let other people know the alarm time. Further, by setting the "weak sound", it is possible for the user to know the alarm time without bothering other people.

Figure 9:
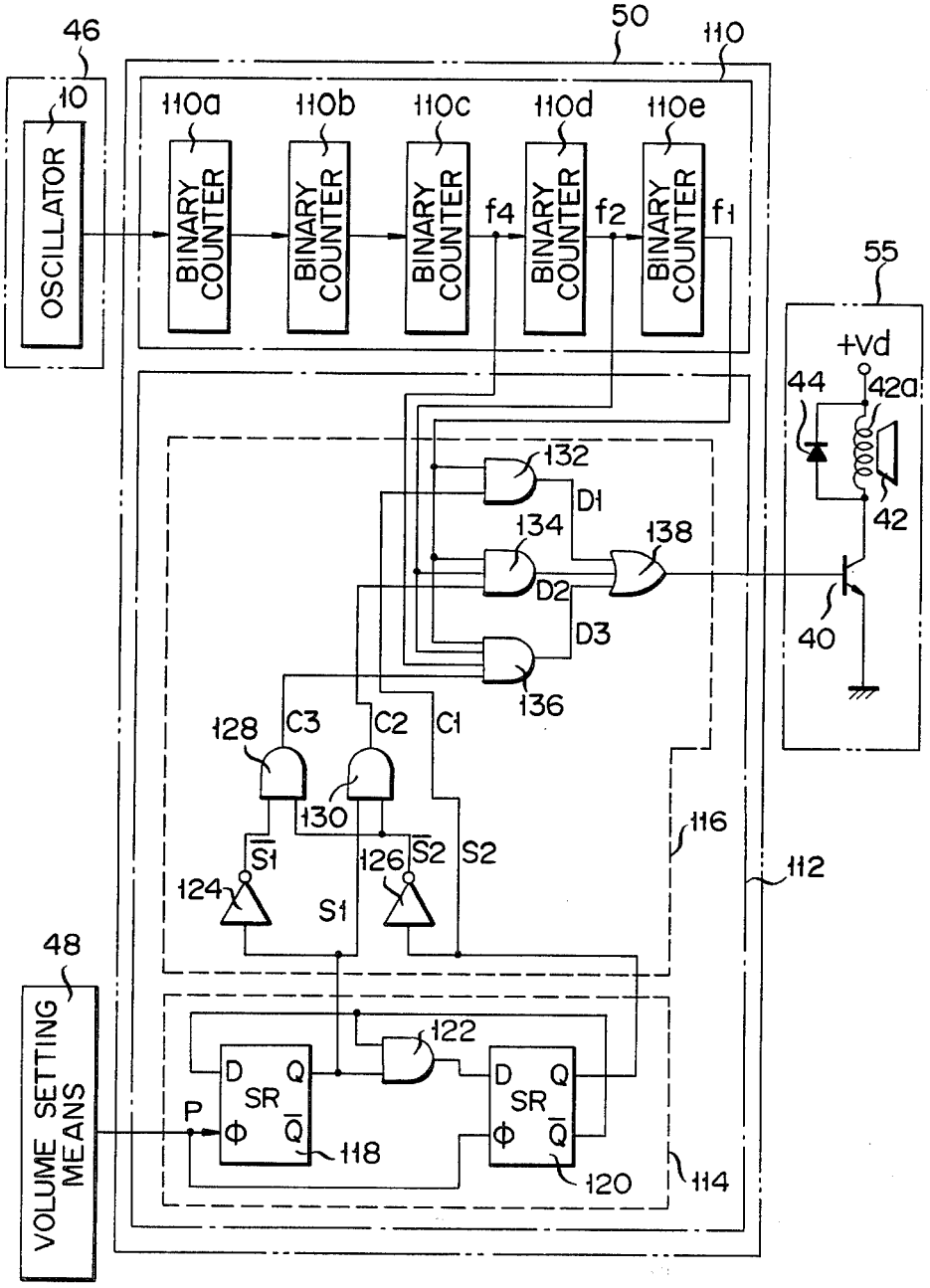
FIG. 9 is a circuit diagram, partly in block form, showing the circuit construction of a modification of the second embodiment in FIG. 7.

While in the second embodiment only the "strong sound" and "weak sound" pressure levels can be set, it is possible to increase the number of presettable sound pressure levels if necessary. In this case, the duty ratio control circuit has to be modified depending upon the number of presettable sound pressure levels. FIG. 9 shows a construction capable of setting three different, i.e., "strong", "medium" and "weak" pressure levels.

In FIG. 9, a signal generated from oscillator 10 is divided by a frequency divider 110. Frequency divider 110 includes a plurality of binary counters 110*a* to 110*e*; counter 110*c* provides a 4-kHz frequency signal f4; counter 110*d* a 2-kHz frequency signal f2; and counter 110*e* a 1-kHz frequency signal f1.

A duty ratio control circuit 112 includes a counter section 114 to which control pulse signal P is supplied, and a logic circuit section 116. Counter section 114 includes first and second D-type flip-flops 118 and 120 and an AND circuit 122. The logic circuit section 116 includes inverters 124 and 126 for inverting the Q terminal outputs S1 and S2 of first and second D-type flip-flops 118 and 120; AND circuits 128 and 130 for providing signals C2 and C3 according to the inversion outputs $\overline{S1}$ and $\overline{S2}$ of inverters 124 and 126 and the output S1 of first D-type flip-flop 118; AND circuits 132, 134 and 136 for providing duty cycle controlled signals D1, D2 and D3 according to outputs f1, f2 and f3 of binary counters 110*c*, 110*d* and 110*e*, outputs C2 and C3 of AND circuits 128 and 130 and output S2 of second D-type flip-flop 120; and an OR circuit 138 for ORing the outputs of AND circuits 132, 134 and 136.

Figure 10:
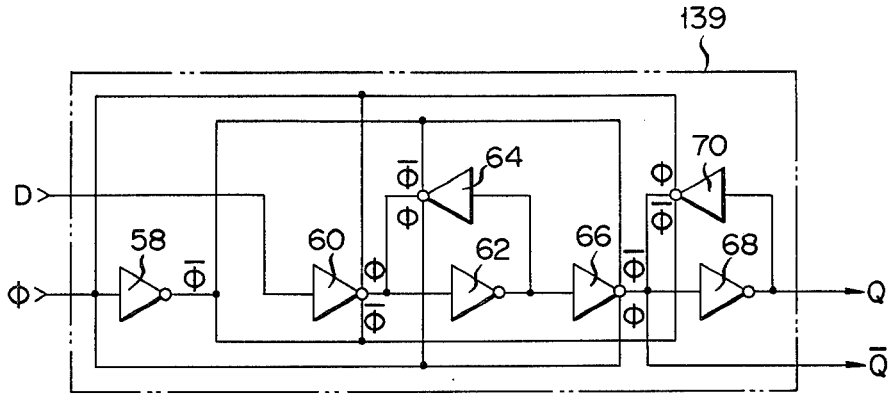
FIG. 10 is a circuit diagram of a D-type flip-flop which may be used for first and second D-type flip-flops 118 and 120 in FIG. 9.

First and second D-type flip-flops 118 and 120 may each have a circuit construction as shown in FIG. 10. In FIG. 10, the same reference numerals and symbols as those in FIG. 2 are used.

Figure 11:
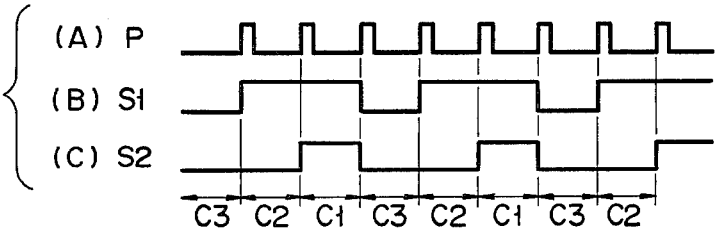
FIGS. 11(A) to 11(C) and FIGS. 12(A) to 12(C) are timing charts for explaining the operation of the modification shown in FIG. 9.

When control pulses P as shown in FIG. 11(A) are supplied to counter 114, first D-type flip-flop 118 transmits a signal as shown in FIG. 11(B), and second D-type flip-flop 120 transmits a signal as shown in FIG. 11(C).

Figure 12:
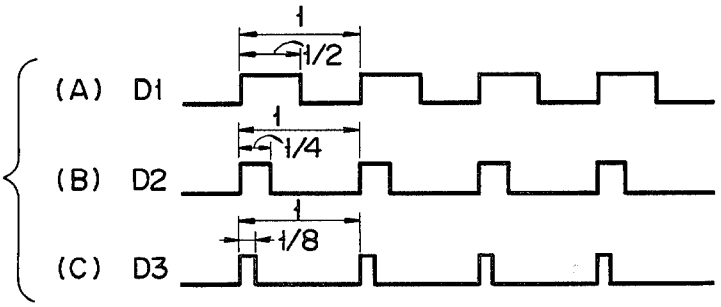

When signals S1 and S2 are both logic "1", signal C1 is logic "1". At this time, a signal D1 as shown in FIG. 12(A) is provided from AND circuit 132. This signal has the same frequency as f1 (1 kHz) and a duty ratio of ½. When signal S1 is logic "1" and signal S2 is logic "0", output signal C2 of AND circuit 130 is logic "1", and a signal D2 as shown in FIG. 12(B) is provided from AND circuit 134. This signal has one half the duty ratio of signal f1, i.e., a duty ratio of ¼. When both signals S1 and S2 are logic "0", output signal C3 of AND circuit 128 is logic "1", and a signal D3 as shown in FIG. 12(C) is provided from AND circuit 136. This signal has one-fourth of the duty ratio of signal f1, i.e., a duty ratio of ⅛. By assigning signals D1, D2 and D3 to the "strong sound", "medium sound" and "weak sound" pressure levels respectively, three different sound volumes can be selected.

Figure 13:
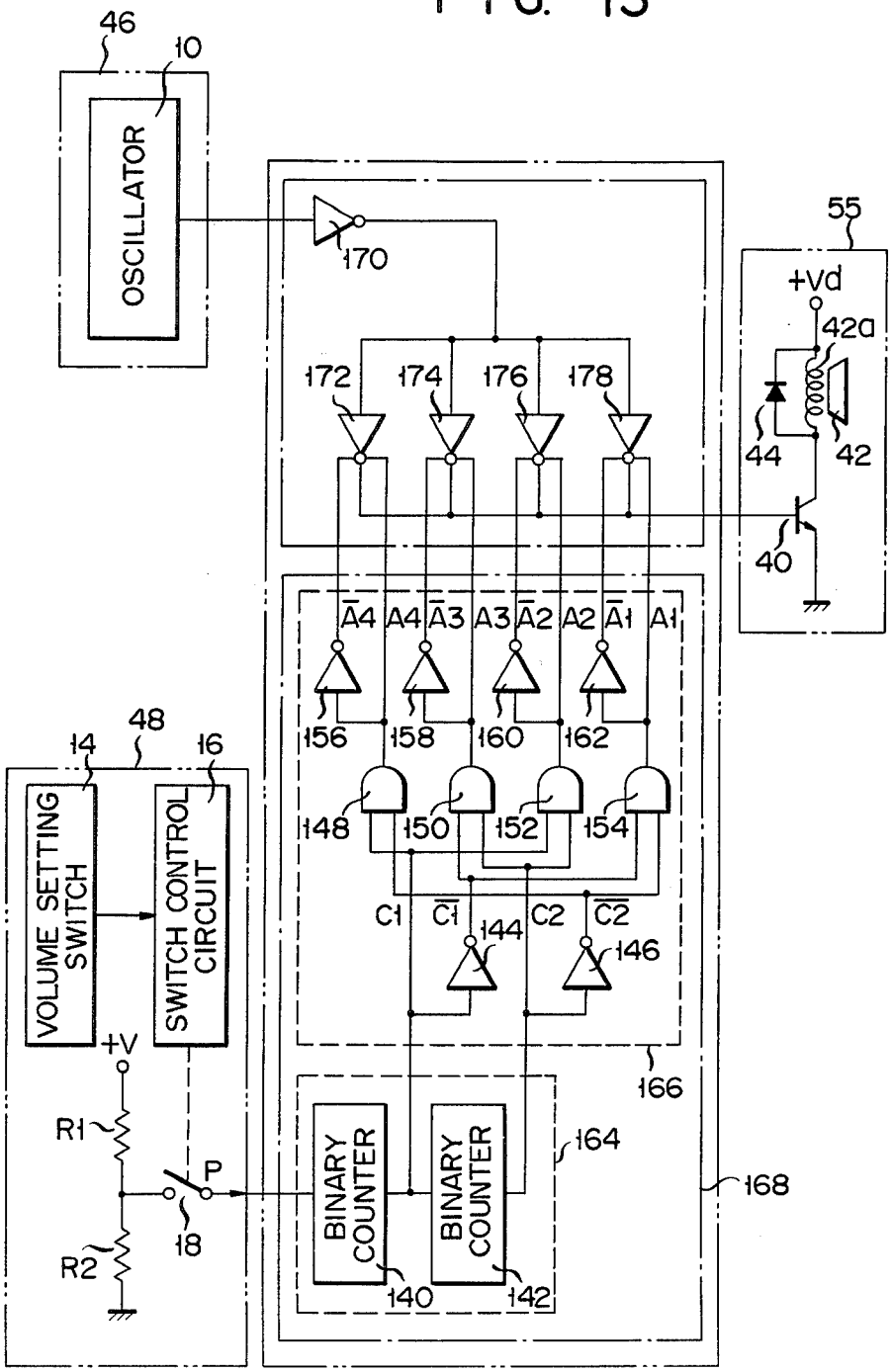
FIG. 13 is a circuit diagram, partly in block form, showing the circuit construction of a third embodiment of the invention.

FIG. 13 is a circuit diagram, partly in block form, showing a third embodiment of the invention. Like parts as those in the first embodiment shown in FIG. 1 are designated by like reference numerals or symbols.

In FIG. 13, control pulse signal P generated from switch 18 of volume setting circuit 48, is supplied to a binary counter 140, and the output thereof is supplied to a binary counter 142. Binary counters 140 and 142 provide respective output signals C1 and C2 according to control pulse signal P. The output terminals of counters 140 and 142 are connected to respective inverters 144 and 146 which invert signals C1 and C2 to provide inverted signals $\overline{C1}$ and $\overline{C2}$.

Signals C1, $\overline{C1}$, C2 and $\overline{C2}$ are supplied to AND circuits 148, 150, 152 and 154 in the illustrated way, and AND circuits 148, 150, 152 and 154 provide respective output signals A1 to A4. The output terminals of AND circuits 148, 150, 152 and 154 are connected to respective inverters 156, 158, 160 and 162 which invert signals A1 to A4 to provide inverted signals $\overline{A1}$ to $\overline{A4}$ respectively.

Counters 140 and 142 constitute a counter section 164. Inverters 144 and 146, AND circuits 148, 150, 152 and 154 and inverters 156, 158, 160 and 162 constitute a logic circuit section 166. Counter section 164 and logic circuit section 166 constitute a control circuit 168.

Figure 14:
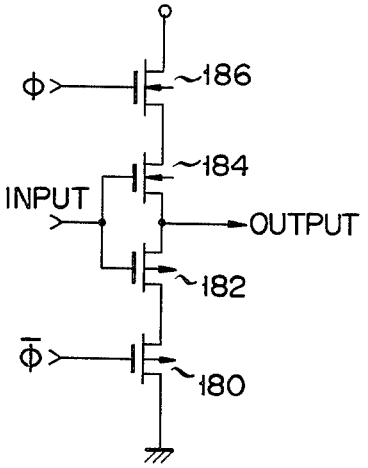
FIG. 14 is a circuit diagram of a clocked inverter capable of amplifying which may be used for clocked inverters 172 to 178 in FIG. 13.

A signal of a predetermined frequency provided from oscillator 10 is supplied through an inverter 170 to amplifiers, for instance, clocked inverters 172, 174, 176 and 178. Clocked inverters 172, 174, 176 and 178 may each have a circuit construction as shown in FIG. 14, including p-channel MOS FETs 180 and 182 and n-channel MOS FETs 184 and 186. Clocked inverters 172 to 178 are so designed that they amplify an input signal with a predetermined amplification degree to provide an amplified current output, when signal $\phi$ and inverted signal $\overline{\phi}$ are simultaneously supplied. These clocked inverters 172, 174, 176 and 178 have different amplification degrees, more particularly, clocked inverter 172 has an amplification degree higher than that of clocked inverter 174, whose amplification degree is higher than that of clocked inverter 176, whose amplification degree is, in turn, higher than that of clocked inverter 178. Signals A1, $\overline{A1}$, A2, $\overline{A2}$, A3, $\overline{A3}$, A4 and $\overline{A4}$ are supplied as operation instructions to clocked inverters 172, 174, 176 and 178 in the illustrated way. The outputs of clocked inverters 172, 174, 176 and 178 are supplied to the base of npn transistor 40.

Figure 15:
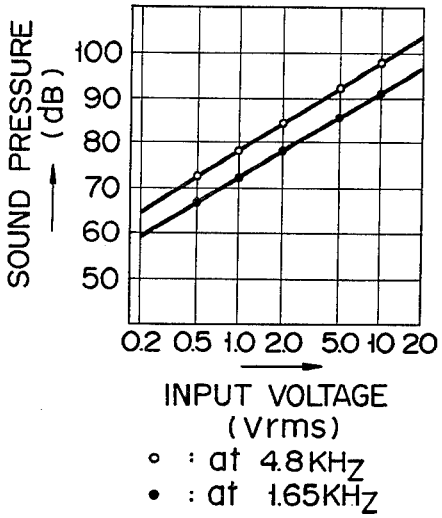
FIG. 15 is a sound pressure versus input voltage characteristic of loudspeaker 42 in FIG. 13.

Loudspeaker 42 has a characteristic as shown in FIG. 15, in which the sound pressure level increases substantially in proportion to the magnitude of an input drive signal voltage. Of course, the sound pressure versus input voltage characteristic may vary with kinds of loudspeakers.

The operation of the above construction will now be described with reference to timing charts of FIGS. 16(A) to 16(G).

Figure 16:
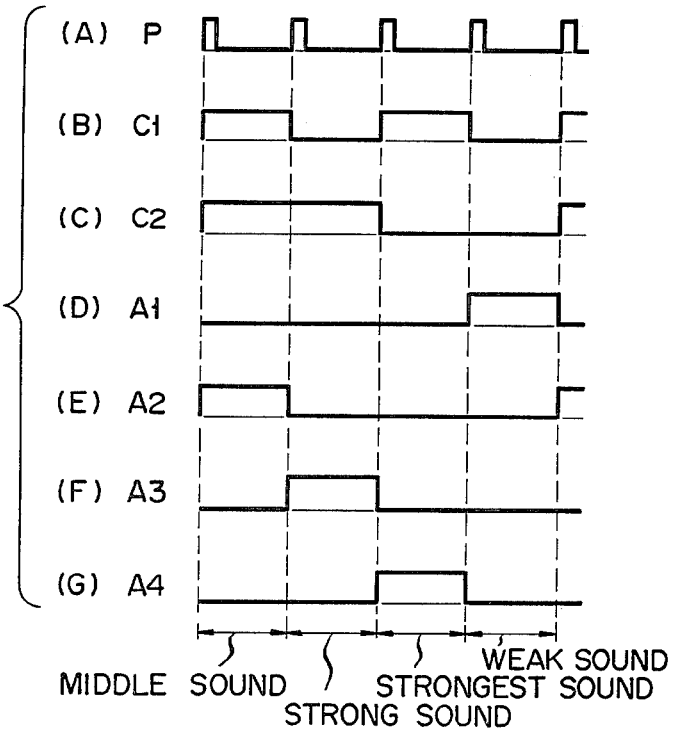
FIGS. 16(A) to 16(G) are timing charts for explaining the operation of the third embodiment shown in FIG. 13.

If the "strongest sound" pressure level is set by switch 14, switch 18 generates a predetermined number (determined by the preset sound volume) of control pulses P (FIG. 16(A)), causing counter 140 to provide output signal C1 of logic "1" (FIG. 16(B)) and counter 142 to provide output signal C2 of logic "0" (FIG. 16(C)). This means that the frequency signal generated from oscillator 10 and obtained from inverter 170 is current amplified by clocked inverter 172 before being supplied to the base of transistor 40. When a given alarm time is reached, the direct current voltage Vd for driving loudspeaker 42 is provided to cause the on-off operation of transistor 40 according to the output of clocked inverter 172, thus supplying a large current drive signal to loudspeaker 42. Thus, the "strongest sound" is generated from loudspeaker 42.

When the "strongest sound" pressure level state is switched over to the "strong sound" one by switch 14, switch 18 is caused to generate three control pulses P, causing output signal C1 of counter 140 to go to logic "0" and output signal C2 of counter 142 to go to logic "1". As a result, output A3 of AND circuit 150 goes to logic "1" (FIG. 16(F)) to render clocked inverter 174 operative. Thus, the frequency signal generated from oscillator 10 and obtained from inverter 170 is current amplified by clocked inverter 174 before being supplied to the base of transistor 40. When the given alarm time is reached, the direct current voltage Vd for driving loudspeaker 42 is generated to cause the on-off operation of transistor 40 according to the output of clocked inverter 174, thus supplying a comparatively large current drive signal to loudspeaker 42. Thus, strong sound is produced from loudspeaker 42.

When the "strong sound" pressure level state is switched over to the "weak sound" one by switch 14, switch 18 is caused to generate two control pulses P, causing both counters 140 and 142 to provide output signals C1 and C2 of logic "0". As a result, output A1 of AND circuit 154 goes to logic "1" (FIG. 16(D)) to render clocked inverter 178 operative. Thus, the frequency signal generated from oscillator 10 and obtained from inverter 170 is amplified by clocked inverter 178 to be supplied to the base of transistor 40. When the alarm time is reached, the direct current voltage Vd for driving loudspeaker 42 is provided to cause the on-off operation of transistor 40 according to the output of clocked inverter 178, thus supplying a smaller current drive signal to loudspeaker 42. Thus, weak sound is produced from loudspeaker 42.

It is to be understood that if the "strongest sound" or "strong sound" is set with switch 14, it is possible for the user to know the alarm time even in a noisy situation and additionally to let other people know the alarm time. Further, by setting the "weak sound" with switch 14, it is possible for the user to know the alarm time without bothering other people or without being known by other people. Further, by setting the "medium sound" with switch 14, both counters 140 and 142 provide output signals C1 and C2 of logic "1". Thus, output A2 of AND circuit 152 goes to logic "1" (FIG. 16(E)), rendering clocked inverter 176 operative. When the given alarm time is reached, the direct current voltage Vd for driving loudspeaker 42 is provided to cause the on-off operation of transistor 40 according to the output of clocked inverter 176, thus supplying a drive current, which is less than the drive current based on clocked inverter 174 but is greater than the drive current based upon clocked inverter 178, to loudspeaker 42. Thus, medium sound is produced from loudspeaker 42. Thus, by setting the "medium sound" with switch 14, the ordinary alarm sound as in the prior art can be obtained.

The foregoing first to third embodiments of the invention are by no means limitative, and can be variously modified. For example, while the first to third embodiments have used volume setting switch 14 for setting the "strong sound", "medium sound" and "weak sound" pressure levels, it is also possible to arrange so that switch 18 can be manually on-off operated predetermined numbers of times corresponding to predetermined sound volume levels. Further, while the first to third embodiments have used a loudspeaker as the sound generating means, it is also possible to use other sound generating means such as a piezoelectric buzzer element. Further, while the sound pressure has been varied by varying the frequency of the drive signal supplied to loudspeaker 42 in the first embodiment, varying the duty ratio of the aforementioned drive signal in the second embodiment and varying the voltage of the drive signal in the third embodiment, according to the invention, it is possible to appropriately combine the first to third embodiments to obtain a multi-stage sound quality control as well as volume control. Various further changes and modifications are, of course, possible without departing from the scope of the invention.

What we claim is:

1. An alarming apparatus comprising:

oscillating means;

sound volume level setting means for setting the volume level of the output sound to one of a plurality of different volume levels;

modulating means for modulating a signal transmitted from said oscillating means according to a signal representing the sound volume level transmitted from said sound volume level setting means, said modulating means comprising a frequency dividing circuit connected to said oscillating means for generating a plurality of frequency signals by frequency dividing the frequency of oscillation of said oscillating means, and a frequency selecting circuit connected to said sound volume level setting means for selecting a predetermined frequency signal among the frequency signals provided from said frequency dividing circuit according to sound volume level setting information; and sound generating means for generating sound according to a signal transmitted from said modulating means, the sound power output level of said sound generating means being a function of frequency.

2. The alarming apparatus according to claim 1, wherein said frequency dividing circuit comprises:

a plurality of binary counters, whereby a plurality of frequency signals are transmitted.

3. The alarming apparatus according to claim 1, wherein said frequency selecting circuit comprises:

a counter circuit section connected to said sound volume level selecting means; and a decoder circuit section for transmitting a signal for driving said sound generating means according to the signals transmitted from said transmitted from said frequency dividing circuit.

4. The alarming apparatus according to claim 1, wherein said modulating means comprises:

a frequency dividing circuit connected to said oscillating means for providing a plurality of frequency signals by dividing the frequency of the signal transmitted from said oscillating means; and a pulse modulating circuit connected to said sound volume level setting means for varying the pulse duration of the frequency signal transmitted from said frequency dividing circuit according to sound volume level information.

5. The alarming apparatus according to claim 4, wherein said pulse duration modulating circuit comprises:

a counter circuit section connected to said sound volume level setting means; and a logic circuit section connected to said frequency dividing circuit for effecting pulse duration modulation according to the signal transmitted from said counter circuit section and the signal transmitted from said frequency dividing circuit.

6. The alarming apparatus according to claim 1, wherein said modulating means comprises:

a control circuit connected to said sound volume level setting means, said control circuit comprising a counter circuit section connected to said sound volume level setting means and a decoder circuit section connected to said counter circuit section for transmitting a control signal according to sound volume level information; and an amplifying circuit connected to said oscillating means for amplifying at different amplification degrees a frequency signal transmitted from said oscillating means according to the control signal from said control circuit.

7. The alarming apparatus accoridng to claim 6, wherein said amplifying circuit comprises:

a plurality of amplifiers connected to said oscillating means and individually set to different amplification degrees, one of said amplifiers being selected according to a control signal from said control circuit.

8. The alarming apparatus according to claim 7, wherein said amplifier comprises a clocked inverter circuit.

* * * * *